United States Patent [19]

Gerster

[11] 4,205,761

[45] Jun. 3, 1980

[54] TENSIONING HOOP FASTENING MEANS

[76] Inventor: Werner Gerster, Hauptstrasse 4, 4149 Hochwald, Switzerland

[21] Appl. No.: 908,352

[22] Filed: May 22, 1978

[30] Foreign Application Priority Data

May 23, 1977 [CH] Switzerland ..... 6298/77

[51] Int. Cl.[2] ..... B65D 45/34; B65D 45/32

[52] U.S. Cl. ..... 220/321; 220/380; 292/256.69

[58] Field of Search ..... 220/319–321, 220/380; 292/256.65, 256.69

[56] References Cited

U.S. PATENT DOCUMENTS

| | | | |
|---|---|---|---|
| 2,079,818 | 5/1937 | Schnorr | 220/321 |
| 3,103,293 | 9/1963 | Beutler | 220/321 |

*Primary Examiner*—George T. Hall

[57] ABSTRACT

A tensioning hoop for sealingly closing a container, such as a drum or barrel, with a matching lid; the hoop is made of an elongated metal member for substantially encompassing the periphery of the lid and the rim of the container aperture; the ends of the elongated metal member form a variable slot and are provided with two substantially flat members forming a hoop actuating device; one end of each flat member is pivotably connected with the flanged upper hoop portion near the slot and both flat members are pivotably connected with each other. The actuating device is shaped in conformity with the hoop so as not to protrude from the outer periphery thereof and can be operated repeatedly for removal of the lid from the container and for closing the container with the lid. The novel tensioning hoop provides for substantial cost reductions and is suitable for use in automated container packaging without manual operation of the actuating device.

8 Claims, 5 Drawing Figures

TENSIONING HOOP FASTENING MEANS

BACKGROUND OF THE INVENTION

1. Field of the Invention

The present invention generally relates to the packaging art and more particularly to tensioning hoops of the type surrounding a container and providing for a releasable connection of the container with a lid. Further, the invention relates to a method for closing a container with a lid by means of a tensioning hoop having a releasable closure or actuating means.

2. Description of the Art

Conventional barrels or drum-type containers for packaging, transporting and storing of liquids, pastes or particulate solids and the like goods are normally made of a relatively thin wall material, e.g. sheet metal, paper board or the like, and provided with a relatively large aperture. In order to increase the stability of the apertured container portion, a rim portion, e.g. constituted by an outwardly extending bead formed or rolled in the container wall material, is provided around the container aperture. A lid substantially matching the container aperture is used for closing the container and normally has a peripheral rim extending over the container aperture. Frequently, the lid rim is provided with a continuous recessed portion or groove provided with a sealant or elastic sealing member for contact with a surface portion of the rim of the container aperture.

A well known means for securing the lid on the container is a tensioning hoop or ring for surrounding both the lid and the aperture rim and having two pressure surfaces in a mutually wedge-like arrangement. One pressure surface of the hoop engages the outer lid rim portion while the other pressure surface engages the rim or bead of the container aperture.

For repeatedly closing and opening the container, one conventional type of the tensioning hoop is provided with a radial gap or slot portion bridged by a "snap means" in the form of a connection between the hoop ends at both sides of the slot that permits to tension or to release the hoop, i.e. a hoop actuating device. In a first or closing position, the gap width controlled by the actuating device is relatively small, e.g. a fraction of an inch, and the tensioning hoop is "contracted" so that its pressure surfaces are in a firm engagement both with the lid and the rim of the container aperture.

In a second or opening position, the gap width as set by the actuating device is relatively large, e.g. an inch or more, and the tensioning hoop is "expanded" so as to permit removal of the lid from the container aperture.

The snap or actuating means, e.g. a conventional pivotable latch arrangement, can be operated for alternatingly contracting the hoop (slot in closing position) and holding it in its contracted and lid-securing position, and for expanding the hoop (slot in opening position) to permit removal of the lid.

Such a conventional tensioning hoop has several draw-backs: The prior art latch arrangement protrudes substantially from the outer hoop periphery and virtually precludes automated closure of a container that has been filled in an automated packaging machine and is supplied with lid plus hoop. Manual operation of the snap latch is required; further the tensioning hoops cannot normally be stacked for easy supply at the packaging station. Also, the protruding structure of the snap latch complicates transport and storage of the closed containers and may be quite hazardous for the operator.

Last but not least, conventional snap-latches for tensioning hoops consist of a plurality, typically about six, components and require separate assembly of the latch and subsequent mounting thereof on the tensioning hoop, e.g. by spot-welding, rivetting and the like.

Accordingly, a main object of this invention is to provide for an improved tensioning hoop in which the hoop actuating means has a simplified yet fully effective structure and does not substantially protrude from the periphery of the hoop.

A further object of the invention is an improved method for sealingly closing a container with a lid using a tensioning hoop that avoids the necessity of manual operation in the use of such container for automated packaging of goods.

Further objects will become apparent as the specification proceeds.

SUMMARY OF THE INVENTION

In accordance with the present invention it has been found that the above objects can be achieved by a tensioning hoop in which the actuating device is removed from a position outside of the outer hoop periphery to a position substantially within the hoop periphery when the actuating device is in the hoop closing position, and by providing the components of the actuating device in close conformity with the external contour of the tensioning hoop.

In a more specific first embodiment, the inventive objects are achieved by a tensioning hoop for releasably securing a lid on a container having a rimmed aperture, said hoop comprising an elongated integral member for substantially surrounding the lid and the rimmed aperture; the elongated member, preferably in the form of a profiled metal band, has two ends which form a radial slot portion of a variable width; the elongated member has a generally tapered upper portion for engagement with the lid and a flanged lower hoop portion for surrounding the rimmed container aperture; the tensioning hoop is provided with an actuating device connected with the ends of the elongated hoop member for varying the width of the slot or gap portion between a first or closing position in which the hoop is tensioned or contracted so that the upper hoop portion is in engagement with the lid, and a second or opening position in which the hoop is expanded so that its upper portion is disengaged from the lid and—when the flanged lower hoop portion is bent for engagement with the rimmed aperture— also disengaged from the rimmed container aperture. According to a first general embodiment of the invention, the hoop actuating device is made of a single and substantially flat link pivotably attached on one end to the upper hoop portion near the slot end and a handle pivotably attached at one of its ends to the upper hoop portion near the slot; the other end of the flat link is pivotably attached to the handle at a part thereof distanced from its pivotably attached end; when the hoop actuating device holds the gap in its closing position, the device substantially conforms with the surface contour of the tensioning hoop, i.e. does not provide any substantial protrusion therefrom.

The novel tensioning hoop provides for an improved method of closing containers with lids. According to a second general embodiment of the invention, such method comprises the steps of: providing the tensioning hoop with a cylindrically shaped lower flanged end portion defining an opening of sufficient diameter for receiving the rim portion of the container aperture while the slot portion is maintained by the hoop actuating means in the first or closing position; forming an assembly of lid and tensioning hoop in engaging relation, i.e. with the actuating device holding the slot in closing or contracted position; putting the assembly on the container aperture so that the opening formed by the cylindrically shaped flanged end of the hoop receives the rim of the container aperture; and bendingly deforming the cylindrically shaped flanged end portion of the tensioning hoop for engagement with the rim of the container aperture so as to secure the lid on the container without operating the loop actuating means.

As circular container apertures and correspondingly circular lids will normally predominate in packaging of liquid, pasty and particulate goods, a preferred tensioning hoop according to the invention will be substantially circular and a preferred specific embodiment of such circular structures will be discussed in more detail below. However, the invention is not restricted to circular or ring-shaped hoop structures and oval hoop structures are contemplated by the invention as well.

By the same token, while many preferred hoop structures according to the invention will be made of sheet metal, notably iron and iron alloys including steel, other structural materials with suitable anti-corrosion properties including plastics may be employed.

BRIEF DESCRIPTION OF THE DRAWINGS

The present invention will now be explained in more detail with reference to the accompanying drawings in which.

DESCRIPTION OF THE PREFERRED EMBODIMENTS

Figure 1:
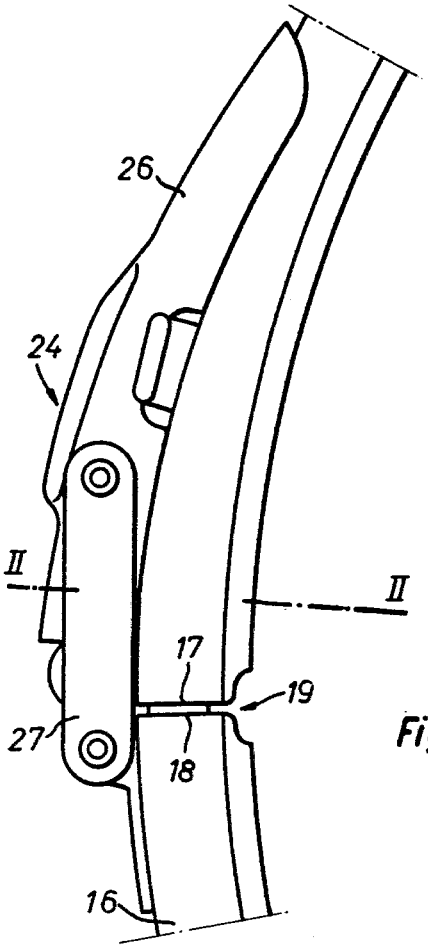
FIG. 1 is a partial top view of a conventional lid/tensioning hoop assembly with a peripherally protruding hoop actuating device.
Figure 2:
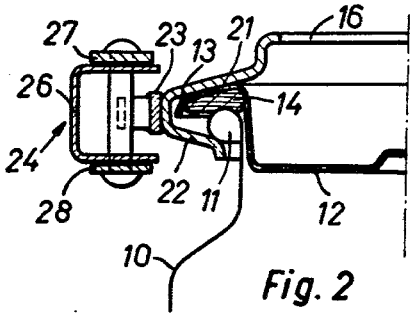
FIG. 2 is a cross-sectional view of the assembly shown in FIG. 1 taken along II—II of FIG. 1.

The structure of a conventional tensioning hoop with associated peripheral hoop actuating device is shown in FIGS. 1 and 2 in partial top view and in cross-section together with a portion of a lid and of a container aperture, the latter being shown in FIG. 2 only. The broken-away portions of hoop and lid are but continuations of the regular hoop and lid portions, the beginnings of which are indicated in FIG. 1.

As is best seen in FIG. 1, container wall 10 is reinforced in the region of the container's aperture to form an externally protruding rim or beading 11. The container's aperture is provided with lid 12 having a circular recess or groove 13 of a generally U-shaped form. Sealing ring 14 is provided in groove 13 for sealing connection with container rim 11. Tensioning hoop 16 is provided around the periphery of lid 12. The two ends 17, 18 of hoop 16 form a gap or slot portion 19 shown in FIG. 1 in a first or closing position. As is seen in the cross-sectional view of FIG. 2, hoop 16 has two portions or surfaces 21, 22 in a mutually wedge-shaped arrangement and interconnected by a bridge or leg portion 23 carrying the hoop actuating device 24 in the form of a conventional snap latch comprising a handle 26 pivotably mounted on bridge 23 near end 17 of hoop 16 and two closure members 27, 28 pivotably secured at a peripheral portion of hoop 16 near hoop end 18. Closure members 27, 28 are pivotably connected with handle 26. When pivoting handle 26 from the position shown in FIGS. 1 and 2 in a direction away from hoop 16, the distance or gap 19 between hoop ends 17 and 18 will be increased to reach a second or opening position in which the hoop diameter is increased so that hoop 16 can be positioned with its portion 21 bearing against circular groove 13 at the peripheral region of lid 12, or be removed from such position. When pivoting handle 26 back into the position shown in FIG. 1, ends 17, 18 will be moved towards each other until gap portion 19 has again reached its first or closing position. As hoop 16 is an elongated member in a circular form, movement of ends 17, 18 will reduce both the peripheral length and the diameter of hoop 16 until surfaces 21, 22 are pressed against lid periphery 13 and aperture rim 11 so that the container is sealingly closed by lid 12.

It will be understood that in the conventional hoop structure shown in FIGS. 1 and 2, hoop 16 can be arranged around lid and container only after opening of the hoop actuating device 26 and must thereafter be closed manually by pivoting handle 26.

As is further apparent from FIGS. 1 and 2, hoop actuating device 24 in its closed position protrudes substantially from the outer periphery of hoop 16 and causes the above described disadvantages, aside from the disadvantages inherent in the multiple-component structure made of six parts, two of which will have to be welded onto hoop 16.

Figure 4:
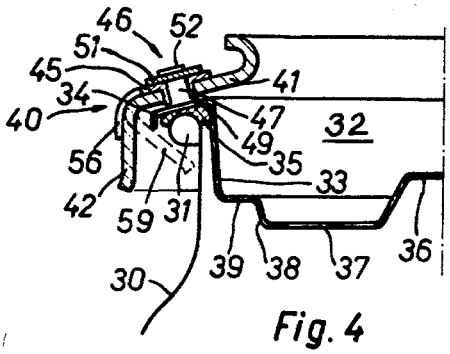
FIG. 4 is a cross-sectional view of the inventive assembly shown in FIG. 3 taken along IV—IV of FIG. 3.
Figure 3:
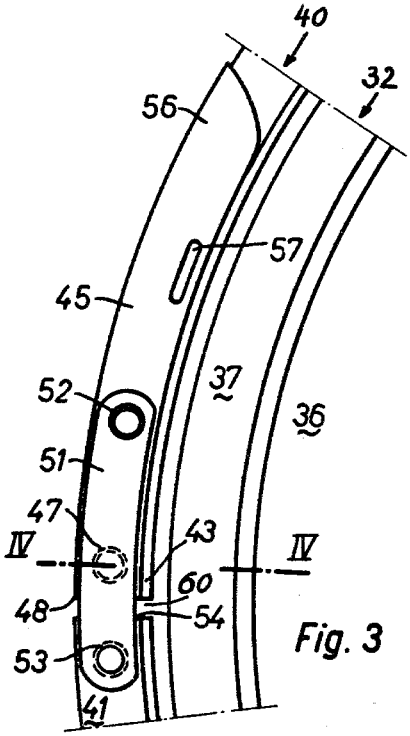
FIG. 3 is a partial top view of a lid/tensioning hoop assembly with a hoop actuating device according to a preferred embodiment of the invention.

A preferred embodiment of the inventive hoop structure is shown in the partial top view of FIG. 3 and in sectional view along IV—IV in FIG. 4 together with a lid portion and a container portion. Again, as explained in connection with FIGS. 1 and 2, the broken-away portions not shown in FIGS. 3 and 4 are but continuations of the regular lines shown.

Container wall 30 of FIG. 4 corresponds with container wall 10 of FIG. 2 and terminates in a conventional rim or beading 31 around the container's aperture. Again, a lid 32 is arranged to rest on the rim 31 of the container's aperture. Lid 32 is provided with a substantially cylindricyl side portion 33 for centering lid 32 in the container aperture so that its substantially U-shaped circular recess 34 with inserted sealing ring 35 will be caused to rest on rim 31. A circular protrusion 37 extending into container 30 is provided in lid 32 between central lid portion 36 and the substantially cylindrical lid portion 33. Lid wall portion 38 adjacent to lid portion 33 is distanced from the latter by a substantially plane circular wall surface portion 39. Both the plane circular portion 39 and lid wall portion 38 serve as supports for stacking a plurality of lid/hoop assemblies as will be explained in more detail in connection with FIG. 5.

Tensioning hoop 40 formed by an elongated member comprises an upper hoop portion 41 of a generally tapered structure and a flanged lower hoop portion 42 surrounding the peripheral portion 34 of lid 32 and rim 31 of the aperture of container 30. As shown in FIG. 4, the flanged lower hoop portion 42 can be provided as a generally cylindrical or non-engaging flange portion and does not engage rim 31 until it is bendingly deformed for such engagement as flange portion 59 shown in broken lines. The upper edge portion of the upper hoop portion 41 is bent in an outward direction for forming a setting ring 43, the function of which for stacking purposes will also be explained below in connection with FIG. 5.

The tapered upper hoop portion 41 carries a two-membered hoop actuating device consisting of a single and substantially flat link member 51 and a handle 45. As is apparent from FIG. 3, both link member 51 and handle 45 do not substantially extend beyond the outer periphery of hoop 40 and are substantially limited by the radial width of upper hoop portion 41. While the operating end 56 of handle 45 may be bent somewhat beyond the upper hoop portion 41 so as to extend about a portion of flange 42, any protrusion of the hoop actuating device beyond the outer periphery of hoop 40 will essentially be limited to the wall thickness of handle 45 and the actuating device is generally shaped to conform with the contour of the hoop.

One end of link 51 is pivotably connected with upper hoop portion 41 near end 54 of hoop 40. Such pivotable connection is preferably made by a hollow rivet 53 shaped directly from the wall material of link 51, e.g. by punching, and extending through an opening in upper hoop portion 41. The end of hollow rivet 53 extending through upper hoop portion 41 is expanded or crimped in a rivetting manner known per se so that link 51 can be pivoted around rivet 53.

The opposite end of link 51 is pivotably connected with handle 45, again with a hollow rivet 52. However, rivet 52 is made from the material of handle 45 and extends upwardly through an opening of link 51 with the upper end of rivet 52 being expanded in a rivetting manner to pivotably interconnect link 51 and handle 45.

The end of handle 45 opposite its operating or grip end 56 is pivotably connected with the upper hoop portion 41 by means of a third hollow rivet 47 shown in FIG. 3 in broken lines as it is covered by link 51 when the latter is in the lid-engaging hoop-contracting position shown in FIG. 3. As is shown in FIG. 4, hollow rivet 47 is made from the material of handle 45, extends through an opening in upper hoop portion 41 and has a crimped or expanded rivetting end for pivotably connecting handle 45 and hoop portion 41.

Link 51 extends over slot portion 60 formed between the ends 48, 54 of the elongated member that constitutes hoop 40 when the slot portion is in the first or closing (hoop contracting) position shown in FIG. 3.

When handle 45 is pivoted around rivet 47 in a counter clockwise direction, i.e. with end 56 moving away from hoop 40, one end of link 51 will pivot around rivet 53 while the other end of link 51 pivots around rivet 52. As a result, ends 48, 54 of hoop 40 will move away from each other and gap 60 is widened until it reaches the second or opening position in which both diameter and peripheral length of hoop 40 is increased to the point of disengagement with lid 32 and, when flanged lower hoop is bent as indicated in 59, with rim 39 as well.

So, while the opening/closing function of the hoop according to the invention operates similarly to that of a conventional hoop, two essential and advantageous differences of the inventive structure will be understood when considering the "first" closing operation, i.e. when the hoop is first applied onto a container and its lid, e.g. in an automated filling station. As is apparent from FIG. 4, an assembly of lid 32 and hoop 40 with the lower hoop portion shaped substantially as a cylindrical portion (position 42) can be applied onto rim 31 of container 30 even though the hoop actuating device 46 and gap 60 are in closing position. By bendingly deforming the flanged lower hoop portion 42 into its rim-engaging position 59, e.g. in a conventional bordering device, a sealingly effective closure of container 30 with lid 32 can be achieved without the need of manually or otherwise operating hoop actuating device 46. However, once such first closure operation has been accomplished, actuating device 46 can be operated repeatedly to open and close container 30 with lid 32 in conventional manner.

Figure 5:
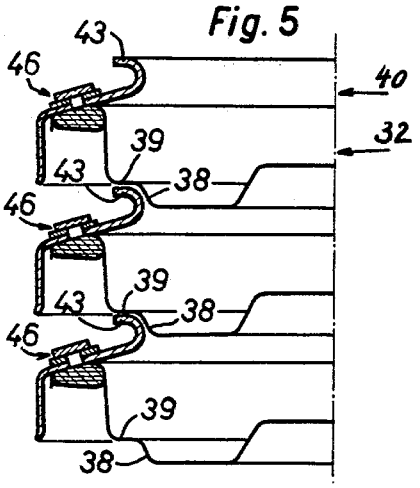
FIG. 5 is a partial cross-sectional view of several lid/hoop assemblies in a stacked relation showing preferred features of the inventive hoop structure.

As mentioned above, the inventive hoop structures can be assembled with lids and the resulting assemblies can be stacked. The partial sectional view shown in FIG. 5 illustrates a stack portion consisting of three lid/hoop assemblies each made from a "new" (flanged lower hoop portion 42 still in its cylindrical shape) hoop 40 according to the invention and a lid 32. As is apparent from FIG. 5, each lid on top of an underlying assembly rests with its circular recessed surface 39 on the setting ring 43 of the underlying hoop and is centered by lid wall portion 38 therein.

Stack arrangements as shown in FIG. 5 have the advantage of providing for a fully automated lid closure operation of containers 30 in a packaging station. After automated filling of each container 30, an automated grip means picks up the uppermost lid/hoop assembly of the assembly stack and places it on the container aperture. Then, the operating head of an automated bending or bordering device deforms the flanged lower hoop portion 42 into the rim-engaging position 59 shown in FIG. 4 so that hoop 40 firmly presses lid 32 with its groove 34 and the sealing ring 35 inserted therein onto rim 31 of the container aperture.

It will be understood that bending of flange 42 into position 59 is an advantageous but not a necessary part of using the novel hoop structure and flange 42 can be pre-bent into position 59 in the course of hoop manufacture if no automated filling operation is to be used.

The structure of the hoop actuating device of the inventive hoop provides for various and operationally significant advantages: As it does not substantially protrude from the outer periphery of the hoop, it does not present an obstacle for a bordering machine used in the first closing operation; further, in normal use, the dangers and disadvantages inherent in protruding conventional structures, such as unintentional actuation, hazard to operators, damages of the actuating device when rolling the container around its hoop portion, and the like are prevented.

From a cost and production point of view, the inventive hoop structure is much more simple and less expensive than conventional hoops. In order to ascertain that a closed container supplied by the manufacturer of the goods in the container has not been opened previously, matching perforations 57 (FIG. 3) can be provided in handle 45 and upper hoop portion 41 so that a wire or the like can be inserted and closed to form a loop which is then secured with a lead-seal or the like authentication.

The advantages of the invention as well as certain changes of the disclosed embodiments will be apparent to those skilled in the art. This includes, but is not restricted to, selection of materials, dimensions and shapes of the novel tensioning hoop and its non-protruding actuating device. It is the applicant's intention to cover by the claims all those modifications which could be made to the embodiments of the invention chosen herein for purposes of disclosure without departing from the spirit and scope of the invention.

Protection by Letters Patent of this invention in all its aspects as same are set forth in the appended claims is sought to the broadest extent that the prior art allows.

What is claimed is:

1. In a container having a rimmed aperture, a tensioning hoop in combination with a lid for releasably securing the lid onto the container, said hoop comprising an elongated integral member for substantially surrounding said lid and the rimmed aperture, said member having two ends arranged to form a substantially radial slot portion of a variable width, a generally tapered upper hoop portion for engagement with said lid and a flanged lower hoop portion for surrounding the rimmed aperture of the container, and a hoop actuating device connected with said two ends of said elongated hoop member for varying said width of said slot portion between a first position in which said upper hoop portion is in said engagement with said lid and a second position in which said upper hoop portion is disengaged from said lid; said hoop actuating means essentially consisting of a single and substantially flat link means having a first end pivotably attached to said upper hoop portion near one of said ends of said elongated member and a generally flat handle means having a first end pivotably attached to said upper hoop portion near an other of said ends of said elongated member; said flat link means having a second end pivotably attached to said handle means at a part thereof distanced from said first end of said handle means; and said hoop actuating means being shaped to substantially conform with a surface contour portion of said tensioning hoop when said slot portion is in said first position, and has a radial width substantially limited by the difference between the external and the internal diameter of said hoop member, wherein said upper hoop portion has an offset upper end forming a positioning ring for receiving a peripheral recess of a circular lid when stacking a multiplicity of tensioning rings, each of which is engaged with one of said circular lids.

2. The tensioning hoop of claim 1, wherein said rimmed aperture, said lid and said elongated integral hoop member are substantially circular.

3. The tensioning hoop of claim 1, wherein said flanged lower hoop portion is substantially cylindrical for receiving said rimmed aperture of said container when said slot portion is in said first position and for subsequently bending said flanged lower hoop portion so that the latter engages said rimmed aperture without operating said hoop actuating means.

4. The tensioning hoop of claim 2, wherein said elongated integral hoop member has a radial cross-section substantially in the form of a V-shaped profile, one leg of said profile constituting said generally tapered upper hoop portion and another leg of said profile constituting said flanged lower hoop portion.

5. The tensioning hoop of claim 2, wherein said handle means has a radial cross-section substantially in the form of an L-shaped profile, one leg of said profile extending over said upper hoop portion and another leg of said profile extending downward from said upper hoop portion over a part of said flanged lower hoop portion.

6. The tensioning hoop of claim 1, wherein said pivotable connections of said hoop actuating means are formed by hollow rivets formed from said link means and said handle means.

7. The tensioning hoop of claim 1, wherein said handle means is provided with a perforation matchingly arranged above an other perforation in said upper hoop portion when said slot portion is in said first position for receiving a securing and closure control means.

8. The tensioning hoop of claim 1, wherein said flat link means extends over said slot portion when the latter is in said first position.

* * * * *